United States Patent [19]

Feist

[11] Patent Number: 5,007,188

[45] Date of Patent: Apr. 16, 1991

[54] FRAMING SYSTEM AND COMPONENT PARTS THEREOF

[76] Inventor: Harold E. Feist, 374 Delaware Avenue, Toronto, Ontario, Canada, M6H 2T8

[21] Appl. No.: 442,271

[22] Filed: Nov. 28, 1989

[30] Foreign Application Priority Data

Jun. 19, 1989 [CA] Canada ..... 603198

[51] Int. Cl.[5] ..... A47G 1/06

[52] U.S. Cl. ..... 40/152; 160/371

[58] Field of Search ..... 40/152, 154, 156, 152.1, 40/157, 574; 38/102.2, 102.91; 160/371, 372, 374, 374.1, 378, 380

[56] References Cited

U.S. PATENT DOCUMENTS

| | | | |
|---|---|---|---|
| 3,076,303 | 2/1963 | Durgeloh | 160/380 X |
| 3,552,476 | 1/1971 | Le Tarte | 160/371 |
| 3,611,604 | 10/1971 | Saltzman | 40/152 |
| 3,729,045 | 4/1973 | MacDonald | 160/371 |
| 4,754,566 | 7/1988 | Gordon | 40/156 X |

*Primary Examiner*—Kenneth J. Dorner
*Assistant Examiner*—J. Bonifanti
*Attorney, Agent, or Firm*—Kenneth M. Garrett

[57] ABSTRACT

A framing system for paintings comprises a foam plastic board surrounded by a channel in gripping engagement. The channel is provided with a pocket around the outer wall into which canvas can be tucked and gripped. The channel has a slot on the underside for receiving a mating wall of a framing member which extends above the opening to the pocket to provide a decorative mask.

16 Claims, 3 Drawing Sheets

FRAMING SYSTEM AND COMPONENT PARTS THEREOF

FIELD OF INVENTION

This invention relates to a framing system and framing elements therefor for use in the framing of painting canvases or the like.

BACKGROUND OF INVENTION

Traditionally, painting canvases have been mounted on a framework, and the mounted canvas then surrounded by a decorative frame. The most rudimentary system employs a strainer framework of fixed dimensions, and requires the canvas to be tensioned prior to it being fixed to the framework, usually by nailing or stapling. Another system employs a stretcher framework to which the canvas is nailed or stapled and which can be expanded to increase tension on the canvas. In either case the framework is normally secured within a decorative surrounding frame, again by nailing or using staples. These arrangements are relatively permanent i.e. they do not readily permit the canvas to be readily re-tensioned, nor to be demounted from the framework for transportation and storage, for example. Moreover, the nails/staples promote the decay of the canvas over a period of time.

A further disadvantage with the foregoing arrangements is that the canvas is not normally backed in the mounting framework. Accordingly it must be stretched quite tightly prior to it being painted, thus tending to deform and weaken the fabric over a period of time. It is also susceptible to mechanical damage. Increasingly it has been found that exposure of the non-painted surface of the canvas to the atmosphere is deleterious.

It is an object of this invention to provide an improved framing system for painting canvases and the like.

It is another object of the invention to provide an improved framing system that permits the mounting of canvases without the use of nails and staples or the like and their concomitant disadvantages.

It is yet another object of the invention to provide a framing system that permits the ready demounting of canvases for storage, transportation or adjustment of tension.

It is a further object of the invention to provide a mount wherein canvases are supported from the back.

It is a still further object of the invention to provide in such framing system a decorative frame that can be readily assembled onto and disassembled from the mounted canvas.

It is yet a further object of the invention to provide a framing system that is relatively inexpensive and light.

SUMMARY OF INVENTION

The framing system to which the invention is applied broadly comprises a mount for fabric material and a decorative frame therefor. The mount includes a top wall, a bottom wall interconnected side wall and has a perimeter therearound. In accordance with the invention, the mount is provided on the side wall with integral gripping means for the fabric material, and cooperating means are integrally formed on the frame and on the mount beneath the gripping means for retaining the frame in position about the mount.

In accordance with the preferred aspect of the invention the top wall, side wall and bottom wall define in part a mounting member having a channelar opening therealong. Suitably the mount includes a central support, conveniently in the form of a foam board received within the channel opening of the mounting member, or mounting members where there are a plurality thereof.

The gripping means desirably comprises a jaw rooted to the sidewall, to define therewith a pocket in which the fabric material may be tucked and retained. Preferably the pocket is structured to provide a constriction adjacent the opening thereto, and is further formed with gripping teeth in the constriction.

Suitably the means for retaining the frame comprises a slot into which a flange may be exerted. Conveniently the bottom wall of the mount member is provided with a lip that together with the bottom wall forms the slot, and the flange forms part of the decorative frame.

In accordance with the preferred embodiment the decorative frame has a generally rectangular C shaped channelar cross section formed in part by the flange, and in part by a valance which masks the opening to the fabric receiving pocket. Desirably the valance is somewhat resiliently movable with respect to the mount, so as to be sprung relatively tightly against fabric extending along the side wall of the mount and provide a seal therefor.

These foregoing objects and aspects of the invention, together with other objects, aspects and advantages thereof will be more apparent from the following description of a preferred embodiment thereof, taken in conjunction with the following drawings.

DESCRIPTION OF THE PREFERRED EMBODIMENT

Figure 1:
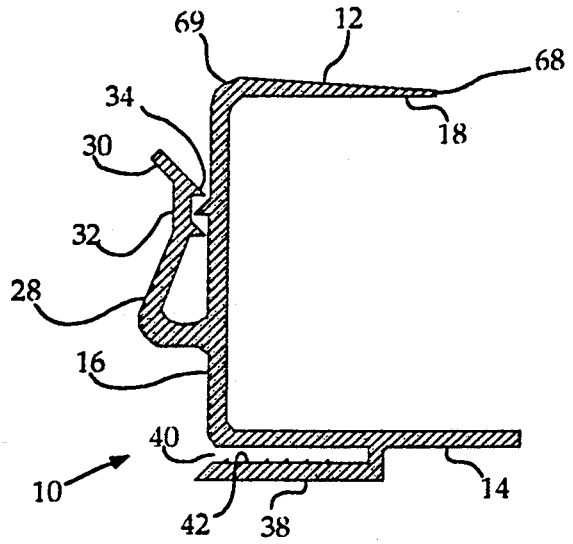
FIG. 1 shows in transverse cross section a mounting member in accordance with the invention.
Figure 2:
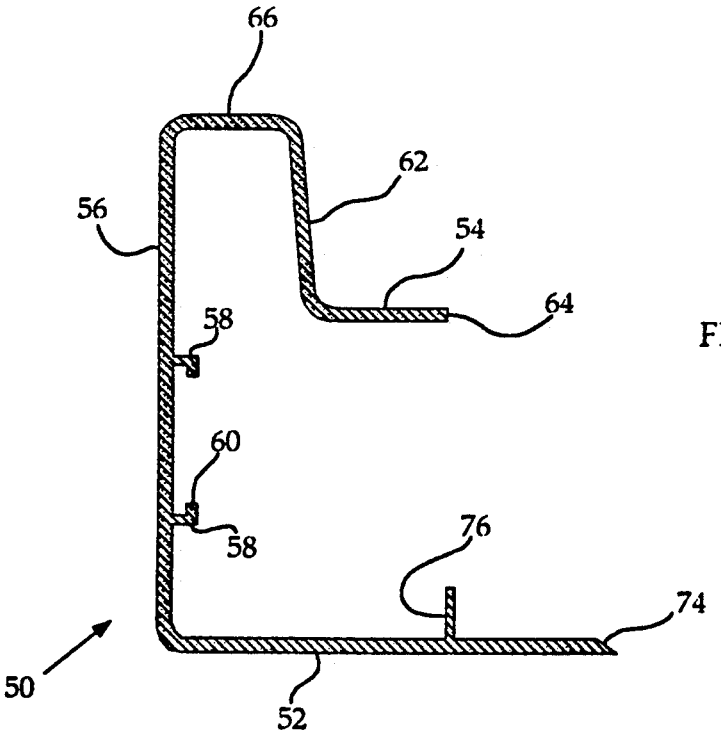
FIG. 2 shows in transverse cross section a framing member in accordance with the invention.
Figure 3:
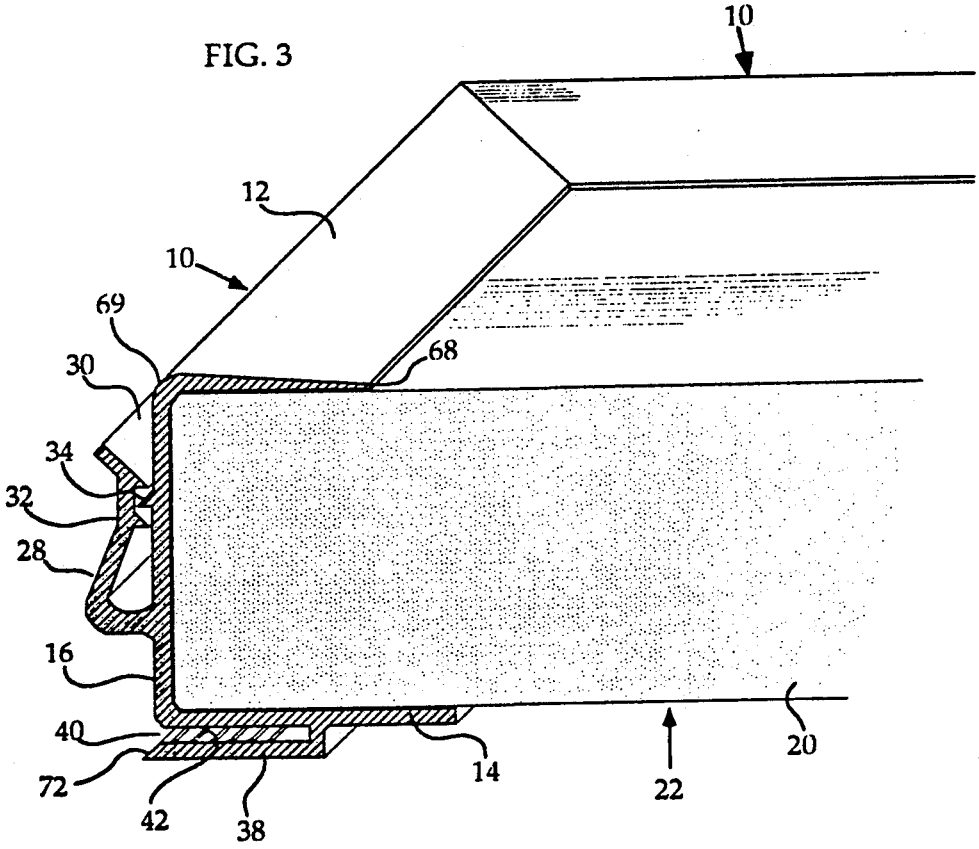
FIG. 3 shows in isometric fragmentary view on a mounting board in accordance with the invention.
Figure 4:
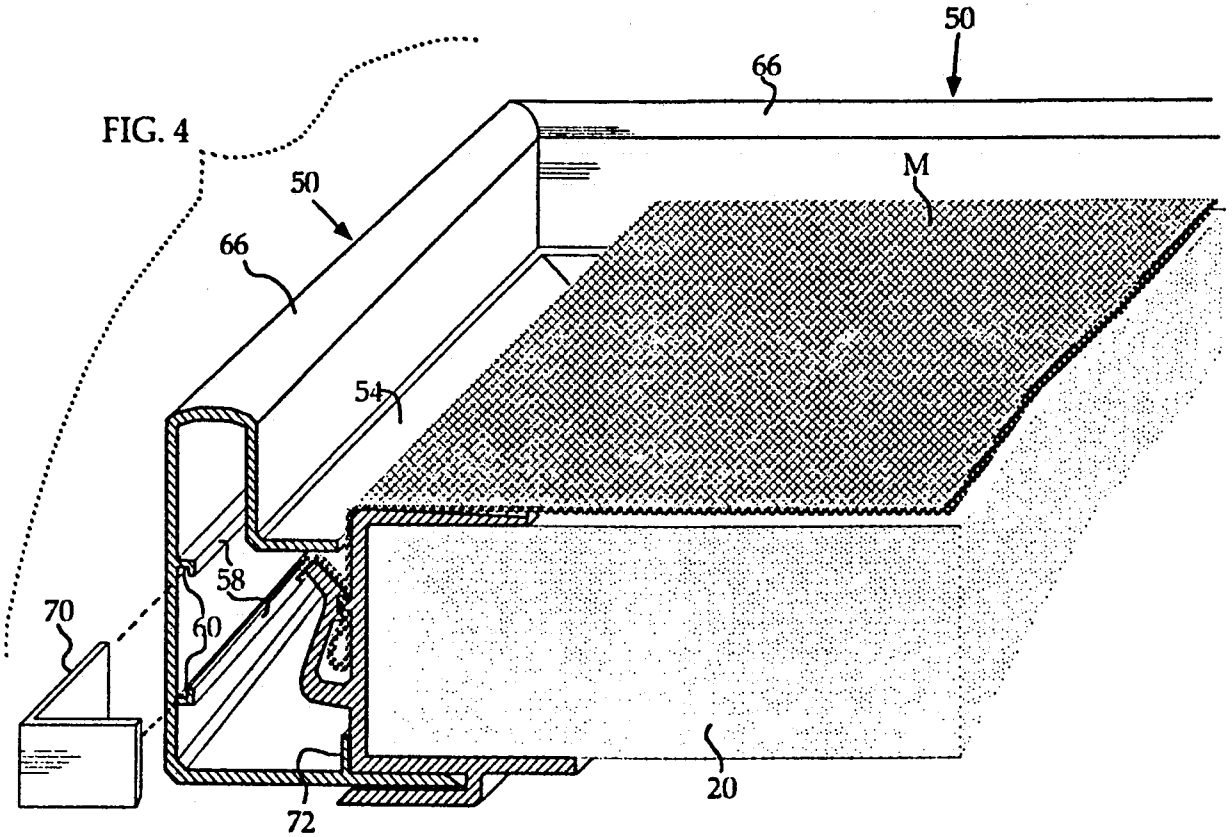
FIG. 4 shows in isometric exploded fragmentary view a portion of fabric mounted on the board and framed in accordance with the invention.

Considering the drawings in detail, a framing system in accordance with the invention employs a mounting member 10 having a generally rectangular C shaped cross-section defined by a top wall 12, bottom wall 14 and an interconnecting side wall 16 and having a channel opening 18 therealong.

Mounting member 10 is supported on a central support 20 conveniently and preferably formed of expanded i.e. foamed plastic sheet material, with foam polystyrene being preferred, which is received in channel opening 18 in tightly gripping relationship, the mounting member and central support thereby forming a mounting board 22.

Mounting member 10 further comprises a jaw 28 rooted at its lower end to side wall 16 and forming therewith an upwardly opening pocket 30. Jaw 28 is shaped to provide a constricted area 32 adjacent the opening of pocket 30, and the constricted area is provided with relatively large opposed gripping teeth 34. Mounting member 10 additionally comprises a lip 38 rooted at its inwardly facing end to bottom wall 14 to form therewith a slot 40 opening outwardly. Slot 40 has a generally rectangular cross section, and is provided with relatively small gripping teeth 42 therealong raised on lip 40.

Suitably mounting member 10 is formed as an extrusion and the various component parts are axially coextensive therealong, as is slot 42 and pocket 30.

The framing system of the invention further includes a frame member 50. Frame member 50 comprises a flange 52, a valance 54 interconnected by frame wall 56, to define a hollow generally rectangular C shaped channelar cross section.

Frame wall 56 is provided with a pair of opposed L shaped walls 58 defining an axially aligned keyway 60. Suitably and preferably, frame member 50 is formed as an extrusion whereby the various walls thereof are coextensive therealong. Valance 54 is formed with a downward step 62 marginally forwardly downwardly inclined and axially aligned with inward edge 64 thereof. The step 62 permits valance 54 to move resiliently, and also has a decorative function in providing a shadow-box appearance to the frame. Additionally the upper portion 66 of step 62 will, when frame member 50 is engaged with channel 10 of mounting board 22, generally extend upwardly at least to the plane of top wall 12 or thereabove, thereby providing a protective function for a framed, mounted painting.

It is believed that the use of the framing system of the invention will be evident from the foregoing description thereof, although practical experience has shown that certain modes of use may be preferable over others. In assembling mounting board 22, central support 20 is cut to the requisite dimensions and mounting member 10 is mounted thereon about the periphery thereof. Central support 20 and mounting member 10 may each be unitary, or one or both may be formed of several portions, provided, of course, that any join lines therebetween are staggered so as not to extend continuously across both the support and mounting member. It is generally preferred that corner joints of mounting member 10 be mitred. Since the corner joints will be hidden, it is not a pre-requisite that such joints be precise. However, where the system is intended to be used in a "do it yourself" application, short lengths of left and right mitre joins may be sold, leaving the assembler the task of making right angled cuts only. Typically such type of assembly will comprise some twelve separate portions of mounting member 10 to enclose the periphery of a rectangular mounting board 22, but a layer or smaller number may be used as is convenient. In all events it is not required that pocket 30 or slot 40 be continuous around the perimeter of mounting board 22.

Following assembly of mounting board 22, fabric material M is draped thereover and the margins thereof tucked into pocket 30 using any convenient flat bladed tool (not shown) for this purpose. The stretch and tension of the material can be easily and precisely controlled during the tucking step. Since the material M is fully supported on the rearward side by panel 20, it is neither desirable nor necessary that excess tension be applied to the material. The mounting of mounting member 10 onto central support 20, where this is of relatively low density foamed plastic tends to compress the central support, and reduce the ridge formed along the inward facing edge 68 of top wall 12; the ridge is still further reduced progressively reducing the thickness of top wall 12 from the outer edge 69 towards the inner edge, in a bevel. Preferably outer edge 69 is formed with a relatively large radius, so as to reduce the tensile and compressive forces on material M in this area.

Decorative frame member 50 may be applied about mounting board 22 in a continuous length by suitably V-notching the corners, or as individual portions cut to length and mitred. When individual portions of frame member 50 are employed, L shaped corner reinforcements 70 may be inserted into keyways 60 during the assembly. Assembly of frame member 50 onto mounting board 22 whether by way of one or more lengths of the frame member simply requires the forcible engagement of flange 52 into slot 42. In order to facilitate the entry of flange 52 into slot 42, lip 38 and the flange are each formed with a bevelled edge, respectively number 72 and 74. Flange 52 is preferably provided with a small upstanding locating wall 76 which provides a better positive location of frame member 50 relative to the mounting board 22, and also acts to rigidify the frame member relative to the mounting board. Wall 76 also forms a register in the event that frame member is used with a traditional wooden stretcher or strainer canvas supports.

In its unengaged position, the free edge 64 of valance 54 marginally overhangs locating wall 72. Consequently, as flange 52 enters slot 40, the free edge 64 of valance 54 will progressively bear upon fabric material M overlaying side wall 16, resiliently deforming the valance. Valance 54 functions to mask the fabric material gripping pocket 30, to smooth out any wrinkles in the fabric material that may arise particularly in the corner areas, and to provide a general seal preventing the ready ingress of atmospheric air to the fabric material locating rearwardly thereof.

In that frame member 50 is somewhat resiliently movable in relation to mounting board 22, adjustment of the tension of fabric material M may be carried out subsequently to the frame being installed by springing valance 54 away from the entrance to pocket 30, thereby permitting the entry of a flat bladed tensioning tool.

It will be apparent that many changes may be made to the illustrative embodiment, while falling within the scope of the invention and it is intended that all such changes be covered by the claims appended hereto.

I claim:

1. In a framing system including: a mount for a sheet of fabric material; a decorative frame therefor, said mount having a top wall, a bottom wall interconnected by a side wall defining a channelar cross section having a perimeter therearound, the improvement comprising a foam board received in said channelar cross section;

means integrally formed with said side wall for gripping said fabric material, and cooperating means integrally formed on said mount beneath said means for gripping said fabric and on said frame for retaining said frame in position about said mount.

2. A framing system in accordance with claim 1, wherein said gripping means comprises a jaw rooted to said side wall to define therewith a pocket within which said fabric material may be tucked to be gripped thereby.

3. A framing system in accordance with claim 2, wherein said pocket is provided with gripping teeth therein.

4. A framing system in accordance with claim 2, wherein said pocket extends substantially continuously around said perimeter.

5. A framing system in accordance with claim 2, wherein said jaw is shaped to provide a constriction adjacent the entrance to said pocket.

6. A framing system in accordance with claim 1, wherein said frame mounting means comprises a lip rooted to said bottom wall to define therewith a slot, and said frame includes a flange receivable in said slot.

7. A framing system in accordance with claim 6, wherein at least one of said lip and said flange are provided with a bevelled edge to facilitate the entry of said flange into said slot.

8. A framing system in accordance with claim 1, wherein said frame comprises at least one frame member having a valance which locates above said gripping means to mask said gripping means.

9. A framing system in accordance with claim 8, wherein said valance is resiliently movable to provide a seal against fabric material extending over said side wall.

10. A framing system in accordance with claim 8, wherein said frame member has a channelar transverse cross section defined by a side strip, a lower flange and said valance, and wherein said valance is downwardly stepped along the width thereof to make it resiliently movable.

11. A framing system in accordance with claim 10, wherein said frame member is an extrusion having a constant cross section along its length.

12. A framing system in accordance with claim 1, wherein said top wall is bevelled.

13. A member for use in a framing system, said member having a generally rectangular C shaped cross section having a top wall, side wall and bottom wall, a jaw extending along said side wall defining therewith a pocket opening towards said top wall;

a lip extending along said bottom wall and defining therewith a slot opening towards said side wall, and said pocket and said slot being substantially coextensive with said side wall and said bottom wall respectively.

14. A framing member as defined in claim 13, wherein said pocket is constricted adjacent the opening thereto.

15. A framing member as defined in claim 13, wherein said pocket and said slot are provided with teeth therein extending axially therealong.

16. A framing member as defined in claim 14, wherein said top wall is bevelled.

* * * * *